United States Patent [19]

Kelley

[11] 4,184,809

[45] Jan. 22, 1980

[54] DIAPHRAGM PUMP CONSTRUCTION HAVING PULSATOR PISTON AND MECHANICALLY ACTUATED MEANS TO SUPPLY PULSATOR FLUID

[75] Inventor: Zar W. Kelley, Broadview Heights, Ohio

[73] Assignee: Louis Beck, Seven Hills, Ohio

[21] Appl. No.: 795,957

[22] Filed: May 11, 1977

[51] Int. Cl.[2] ..... F04B 9/08; F04B 35/02

[52] U.S. Cl. ..... 417/360; 417/387; 417/388

[58] Field of Search ..... 417/387, 388, 385, 383, 417/510, 360; 60/589

[56] References Cited

U.S. PATENT DOCUMENTS

| | | | |
|---|---|---|---|
| 2,227,593 | 1/1941 | Lawrence | 60/589 |
| 2,578,746 | 12/1951 | Scherger et al. | 417/388 |
| 2,585,172 | 2/1952 | Reynolds | 417/395 |
| 2,839,002 | 6/1958 | Williams | 417/387 |
| 2,975,599 | 3/1961 | Bennett | 417/383 |
| 3,149,469 | 9/1964 | Williams | 417/387 |
| 3,374,750 | 3/1968 | Hetz | 417/388 |
| 3,680,981 | 8/1972 | Wagner | 417/388 |
| 3,910,727 | 10/1975 | Flynn et al. | 417/387 |
| 3,925,988 | 12/1975 | Kelley | 417/385 |

FOREIGN PATENT DOCUMENTS

| | | | |
|---|---|---|---|
| 849414 | 11/1939 | France | 417/388 |
| 1011826 | 6/1952 | France | 417/387 |
| 1069107 | 7/1954 | France | 417/388 |
| 887774 | 1/1962 | United Kingdom | 417/388 |

*Primary Examiner*—Carlton R. Croyle
*Assistant Examiner*—Thomas I. Ross
*Attorney, Agent, or Firm*—Pearne, Gordon, Sessions

[57] ABSTRACT

A piston diaphragm pump includes a driving fluid chamber and a driven fluid chamber. A flexible diaphragm separates the fluid chambers from one another. An electric motor drives a reciprocating piston through a crankshaft, and the piston moves in the driving fluid chamber from a forward position to a rearward position on a suction stroke and from the rearward position to the forward position on a pressure stroke. An inlet passage extends between a crankcase and the driving fluid chamber, and a normally closed inlet valve in the inlet passage is opened by a cam on the crankshaft when the piston reaches a predetermined position on its suction stroke. The driving fluid in the driving fluid chamber drives the flexible diaphragm back and forth, and the back and forth movement of the diaphragm pumps the driven fluid into and out of the driven fluid chamber.

9 Claims, 6 Drawing Figures

DIAPHRAGM PUMP CONSTRUCTION HAVING PULSATOR PISTON AND MECHANICALLY ACTUATED MEANS TO SUPPLY PULSATOR FLUID

BACKGROUND AND SUMMARY OF THE INVENTION

The present invention relates to pumps of the type known as piston diaphragm pumps. Such pumps include a driving fluid which moves a flexible diaphragm back and forth by operation of a reciprocating piston. The back and forth movement of the flexible diaphragm pumps a driven fluid which may be paint for a spraygun or any other suitable fluid.

Prior art piston diaphragm pumps are shown in British Pat. No. 887,774 to Charles W. Simpson and in U.S. Pat. No. 3,925,988 to Zar W. Kelley.

The present invention departs from these and other prior art piston diaphragm pumps by providing a piston diaphragm pump which includes a housing having a driving fluid chamber and a driven fluid chamber. A flexible diaphragm separates the fluid chambers from one another and is movable between a rearward position and a forward position. A reciprocating piston in the driving fluid chamber is driven by a crankshaft from a forward position to a rearward position on a suction stroke and from the rearward position to the forward position on a pressure stroke. The crankshaft is arranged in a sealed crankcase, and the pump housing is secured directly to a wall of the crankcase.

A small amount of driving fluid is pumped through the driving fluid chamber on each cycle of the piston. The crankcase for the crankshaft provides a pick-up and return reservoir for the driving fluid. A normally closed inlet valve is provided in a passage extending between the crankcase reservoir and the driving fluid chamber. A mechanical actuating device on the crankshaft opens the inlet valve when the piston is in a predetermined position on its suction stroke.

By this arrangement, the amount of fluid pumped through the driving fluid chamber on each cycle of the piston can be controlled simply by changing the point at which the inlet valve is opened and closed. Additionally, a strong spring can be provided on the inlet valve to maintain it in its normally closed position to insure that the inlet valve is closed at the beginning of the pressure stroke of the piston so that fluid is not lost from the driving fluid chamber through the inlet valve before the inlet valve closes on the pressure stroke. Still further, it is believed that this arrangement, coupled with a return spring on the diaphragm, diminishes the magnitude of the negative gauge pressure in the driving fluid chamber on the suction stroke and thereby reduces the formation of air bubbles drawn out of solution from the liquid in the driving fluid chamber on the suction stroke.

BRIEF DESCRIPTION OF THE DRAWINGS

These and other aspects and advantages of the invention will be apparent to those skilled in the art upon an understanding of the preferred embodiment of the invention shown in the drawings, wherein.

DETAILED DESCRIPTION OF THE DRAWINGS

Figure 1:
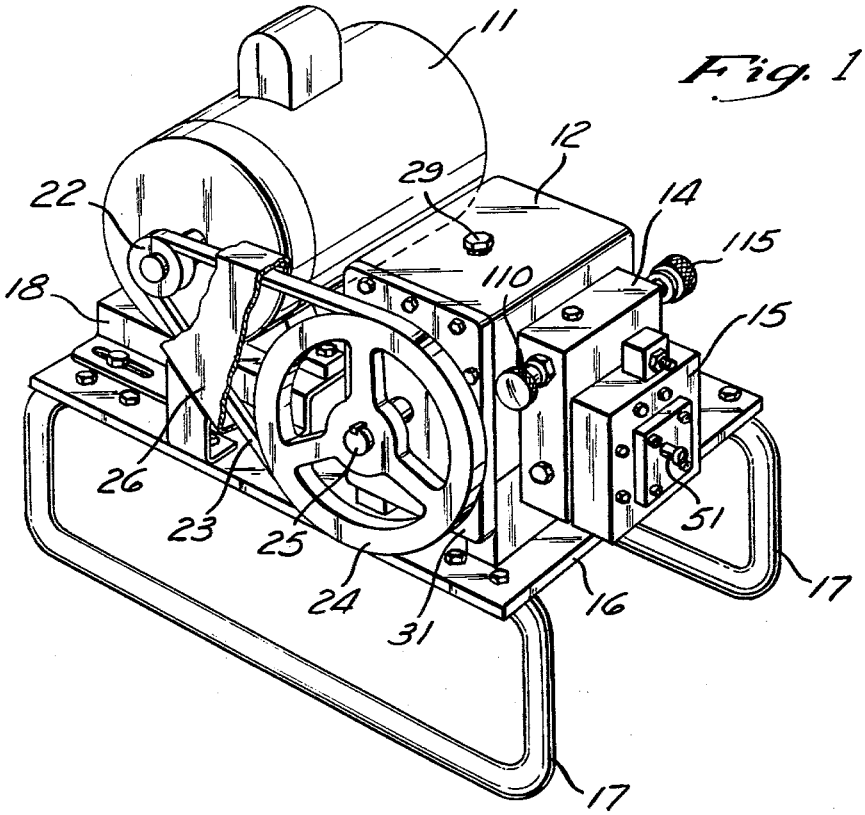
FIG. 1 is a perspective view of a pump according to the principals of the invention.

Referring now to the drawings in greater detail, FIG. 1 shows a pump which includes an electric drive motor 11, a crankcase 12, a rear housing member 14, and a front housing member 15. The drive motor 11 and crankcase 12 are each mounted on a mounting plate 16, which in turn is mounted on two tubular C-shaped legs 17. The drive motor 11 is secured to the mounting plate 16 through an inverted U-shaped adjustment bracket 18, which permits movement of the drive motor 11 relative to the crankcase 12. Alternatively, the drive motor 11 and crankcase 12 may be mounted on a wheeled cart (not shown) or on any other appropriate mounting device.

A drive pulley 22 on the output shaft of the drive motor 11 powers a V-belt 23 to drive a driven pulley 24 which is keyed to a crankshaft 25. A belt guard 26, portions of which have been cut away in the drawing so that other parts of the pump can be seen, is provided to cover the pulleys 22 and 24 and the belt 23.

Figure 2:
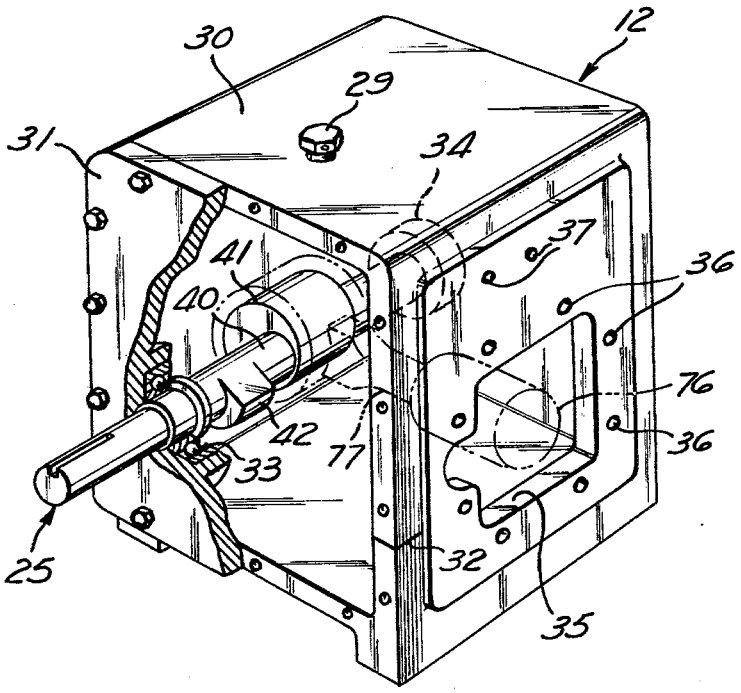
FIG. 2 is an enlarged cutaway perspective view of the crankcase for the pump shown in FIG. 1.

Referring now to FIG. 2, the structural details of the crankcase 12 are shown. The crankcase 12 in the preferred embodiment includes a cast aluminum housing 30, a cast aluminum side cover 31, and a vented fill plug 29. The crankcase 12 is partially filled to a fill line 32 with a liquid (not shown) such as ethylene glycol which serves as both a driving liquid and a lubricant for the pump. Two roller bearings 33 and 34 rotatably mount the crankshaft 25 in the crankcase 12. A suitable seal (not shown) is provided on the side cover 31 outside of the bearing 33 to prevent leakage of the fluid carried by the crankcase 12. A mounting hole 35 is provided in the front wall of the housing 30 to accept another portion of the pump described below. Suitable bolt holes 36 are provided around the periphery of the mounting hole 35 to permit the front and rear housing members 14 and 15 to be bolted to the crankcase 12. Two return passages 37 which are aligned with return passages in the rear housing member 14 as described below also extend through the front wall of the housing 30.

Still referring to FIG. 2, the structural details of the crankshaft 25 are also shown. The crankshaft 25 includes a cylindrical shaft portion 40, a crank portion 41, and a cam portion 42. The function and purpose of the crank 41 and cam 42 will be explained further below.

Figure 3:
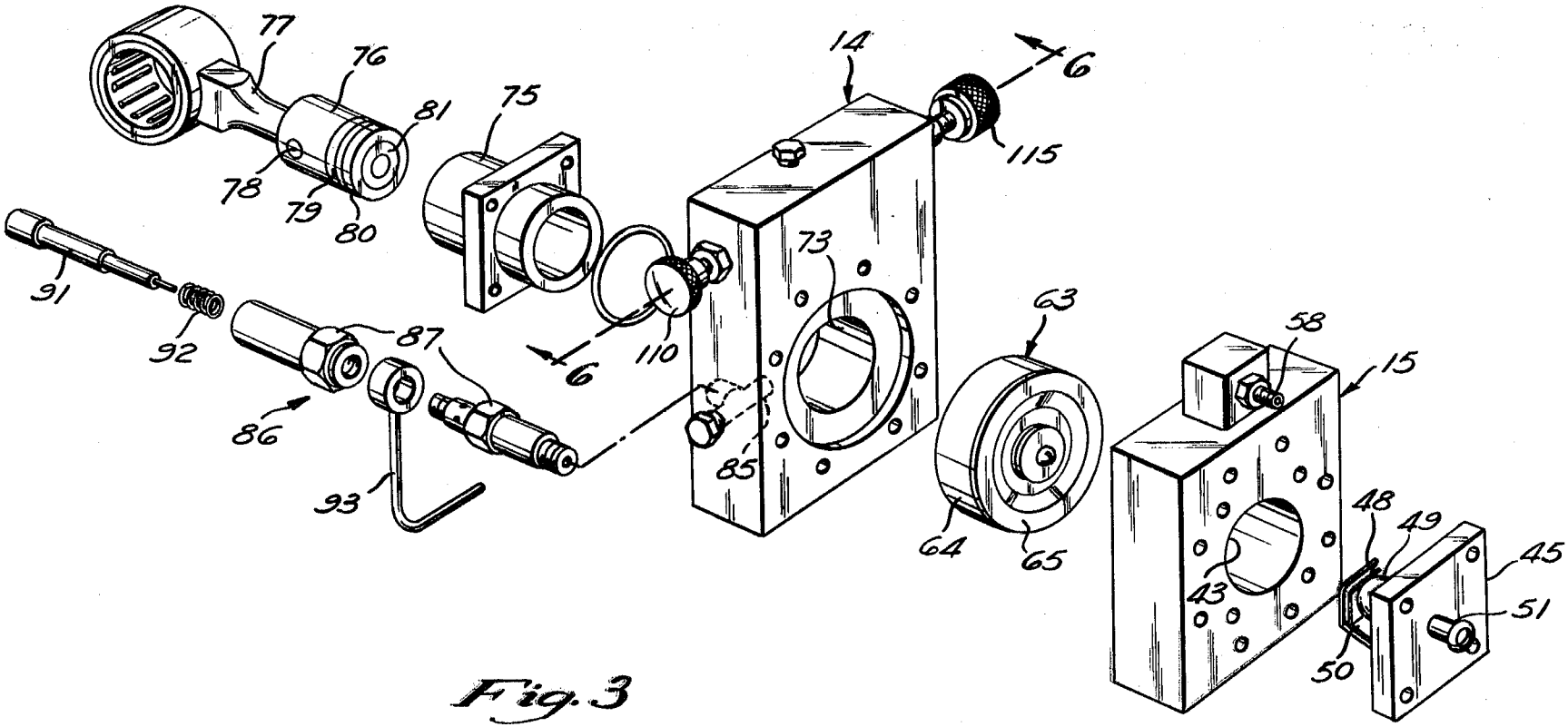
FIG. 3 is an enlarged exploded perspective view of the housing for the pump shown in FIG. 1.
Figure 4:
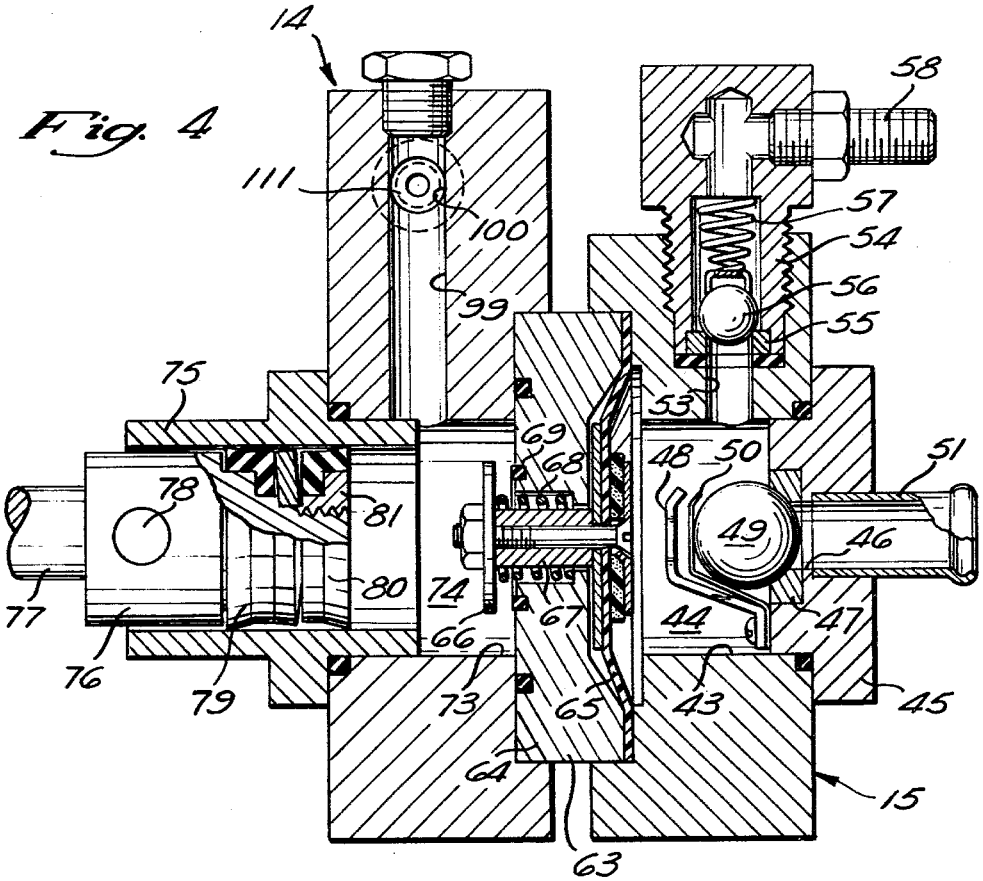
FIG. 4 is an enlarged cross-sectional side elevational view of the housing for the pump shown in FIG. 1.

Turning now to FIGS. 3 and 4 together, the structural details of the rear housing member 14 and front housing member 15 and of the parts associated therewith are shown in detail. The front housing member 15 includes a bore 43 extending from end to end therethrough and defining a driven fluid chamber 44. As explained below, the fluid which is to be pumped, which may be paint or any other fluid, is pumped through the driven fluid chamber 44.

Still referring to FIGS. 3 and 4, an end cap 45 closes the forward end of the driven fluid chamber 44. The end cap 45 is bolted to the front housing member 15 by suitable bolts. The end cap 45 is provided with an inlet passage 46 extending therethrough. A valve seat 47 is provided at one end of the passage 46. A flat sheet metal retainer 48 is fastened to the end cap 45 by suitable screws to secure a ball valve 49 adjacent the seat 47. A thin flat leaf spring 50 is secured between the retainer 48 and the ball 49 to provide a very light biasing force urging the ball 49 against its associated seat 47. The leaf spring 50 is generally of the same shape as the retainer 48 and insures prompt closing of the ball 49 against the seat 47. This arrangement provides better priming of the driven fluid chamber 44 when pumping is initially started. An inlet fitting 51 is provided to connect a source of the fluid which is to be pumped to the inlet passage 46.

The front housing member 15, as best seen in FIG. 4, also includes a vertical outlet passage 53 extending to the driven fluid chamber 44. An outlet valve 54 having a valve seat 55 and a ball 56 is threaded into the end of the outlet passage 53. The outlet valve 54 also includes a spring 57 and a retainer urging the ball 56 against its associated seat 55. An outlet fitting 58 is provided to direct the fluid from the driven fluid chamber 44 to an outlet conduit which carries the fluid to its destination. The outlet valve 54 preferably also includes an air bleed valve (not shown) which is manually actuated to bleed air from the chamber 44 when pumping is initially started.

Continuing with the reference to FIGS. 3 and 4, a diaphragm assembly 63 is provided between the front housing member 15 and the rear housing member 14. The diaphragm assembly 63 includes a backing plate 64, a flexible nylon diaphragm 65, a stop disc 66, and a spacer 67. The diapragm 65 and stop disc 66 and spacer 67 are secured together by a suitable bolt. A heavy coil spring 68 having a spring force of about 15 to 20 pounds biases the diaphragm 65 toward a rearward position shown in FIG. 4. By this arrangement of the spring 68, the diaphragm 65 returns to its rearward position shown in FIG. 4 without need for a suction to pull the diaphragm back to this position, as explained more fully below. An annular seal 69 is engaged by the stop disc 66 to limit the forward movement of the diaphragm 65 and to prevent pressure increases from acting on the left side of the diaphragm 65 after the stop disc 66 engages the seal 69.

With continued reference to FIGS. 3 and 4, the rear housing member 14 includes a bore 73 extending therethrough and defining a driving fluid chamber 74. A cylinder 75 is inserted in the left end of the bore 73 and is secured in place by suitable bolts (not shown). A piston 76 is slidably disposed in the cylinder 75 for back and forth reciprocating movement. A piston rod 77 is connected to the piston 76 by a wrist pin 78. Alternatively, the wrist pin 78 could be replaced with a ball and socket connection. Two oppositely facing cup seals 79 and 80 are secured on the piston by a locking nut 81 for preventing leakage between the cylinder 75 and the piston 76.

Figure 5:
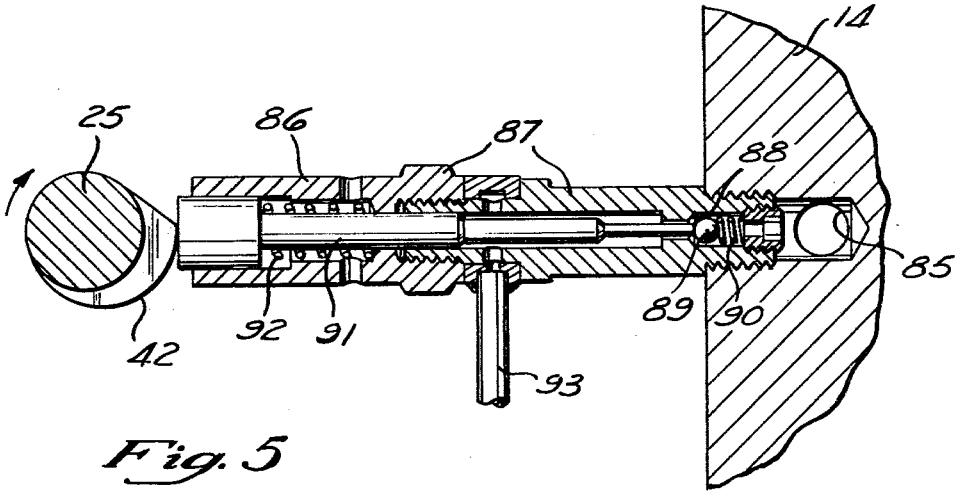
FIG. 5 is an enlarged cross-sectional side elevational view of a valve assembly for the pump shown in FIG. 1.

Referring now to FIGS. 3, 4 and 5 together, a driving fluid inlet passage 85 extends axially from the rear end face of the rear housing member 14 and then radially into the driving fluid chamber 74 for conveying the driving fluid from the crankcase 12 to the driving fluid chamber 74 on a suction stroke of the piston 76 as explained below. A driving fluid inlet valve assembly 86 is threaded into the axially extending portion of the inlet passage 85 in the rear housing member 15. The inlet valve assembly 86 includes a two piece valve housing 87. The valve housing 87 provides a one way check valve which includes a valve seat 88 and a ball 89. A heavy spring 90 biases the ball 89 in a direction toward the valve seat 88. The valve housing 87 also carries an inlet valve actuator rod 91. The actuator rod 91 is held against the cam 42 under all conditions by a coil spring 92. A tube 93 extends from the bottom of the crankcase 12 to the valve housing 87. A suitable filter (not shown) may be placed on the end of the tube 93 in the crankcase 12 to prevent foreign materials from entering the tube 93.

On the suction stroke of the piston 76, the cam 42 pushes the actuator rod 91 against the spring 92 to move the ball valve 89 away from its valve seat 88 against the bias of the spring 90. This establishes an open fluid passage from the bottom of the crankcase 12 through the valve housing 87 and the inlet passage 85 directly to the driving fluid chamber 74. This arrangement permits substantially unimpeded fluid flow from the crankcase 12 through the tube 93 and housing 87 to the driving fluid chamber 74 during a suction stroke of the piston 76. This arrangement also permits precise control of the amount of fluid admitted to the driving fluid chamber 74 during each suction stroke of the piston 76.

Figure 6:
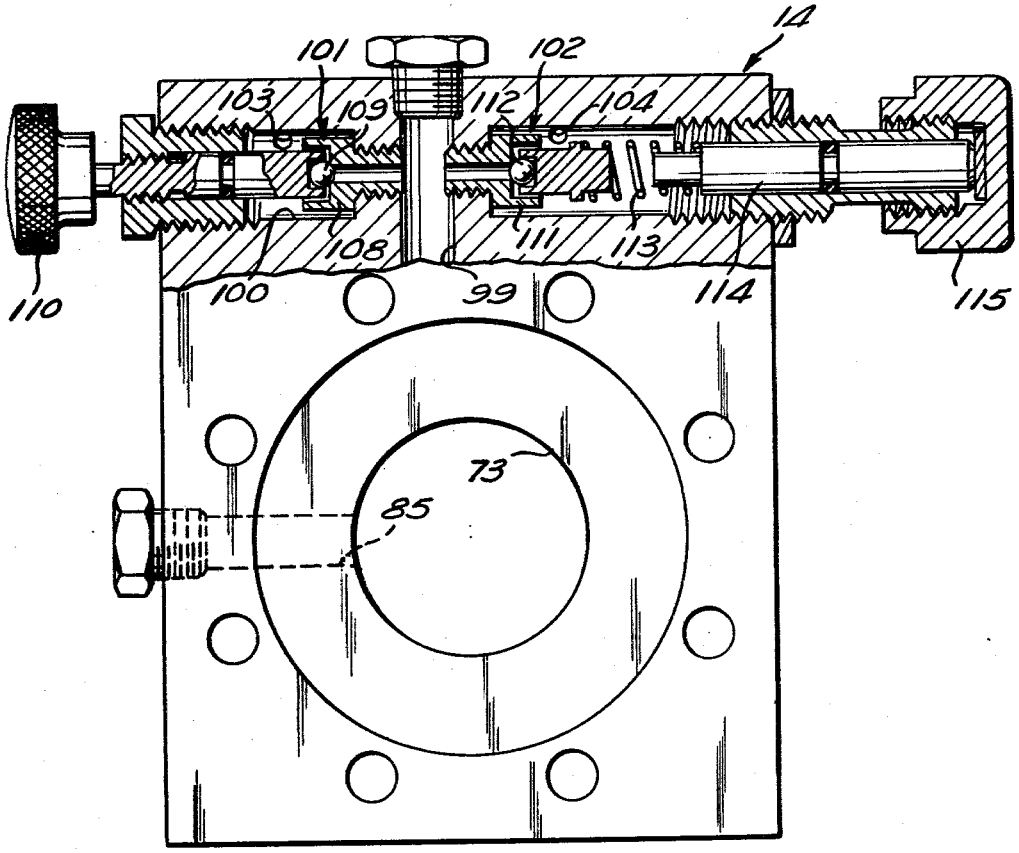
FIG. 6 is an enlarged cross-sectional view taken along reference line 6—6 in FIG. 3.

Referring now to FIGS. 4 and 6 together, the rear housing member 14 also includes a driving fluid outlet passage 99 extending vertically from the driving fluid chamber 74. The outlet passage 99 extends to an outlet valve bore 100 which extends laterally from side to side through the rear housing member 14. An outlet priming valve 101 and a high pressure outlet relief valve 102 are both provided in the outlet valve bore 100. The valve 101 is opened manually to bleed air from the chamber 74 when the pump is initially operated after the driving fluid chamber 74 has been emptied such as would occur when the pump is repaired. The relief valve 102 opens during a pressure stroke of the piston 76 to adjustably control the pressure reached in the driving fluid chamber 74 during pumping, as explained below. Two axially extending return passages 103 and 104 extend from the valves 101 and 102, respectively, to the rear end face of the housing member 14 and communicate with the passages 37 of the crankcase 12 (FIG. 2) to return fluid from the driving fluid chamber 74 to the crankcase 12.

Referring now to FIG. 6, the outlet priming valve 101 includes a valve seat 108 and a ball valve 109. The ball 109 is manually moved toward and away from its seat 108 by turning the knob 110. When the ball 109 is moved away from its closed position shown in FIG. 6 to an open position spaced from the valve seat 108, the ball 109 provides a one way check valve to permit air from the driving fluid chamber 74 and the outlet passage 99 to escape.

The adjustable high pressure outlet relief valve 102 includes a valve seat 111, a ball valve 112 and a spring 113. The spring 113 acts between the ball valve 112 and an adjustment pin 114. The adjustment pin 114 adjusts the preload on the spring 113 by manually turning a knob 115. In this manner, the maximum pressure which may be reached in the driving fluid chamber 74 during the pressure stroke of the piston 76 is set by the operator by adjusting the knob 115 to increase or decrease the pressure required to open the ball valve 112.

Turning now to the operation of the pump shown in the drawings during pumping of the driven fluid chamber, the drive motor 11 (FIG. 1) drives the crankshaft 25 through the V-belt 23. Rotation of the crankshaft 25 causes the piston 76 to move in the cylinder 75 from a rearward position shown in FIGS. 2 and 4 to a forward position on a pressure stroke and from the forward position back to the rearward position on the suction stroke. This reciprocating movement of the piston 76 subjects the driving fluid 74 alternately to positive and negative pressures. This in turn causes the diaphragm 65 to move from a rearward position shown in FIG. 4 to a forward position on a pressure stroke and permits the diaphragm 65 to move from the forward position back to the rearward position on a suction stroke.

With continued reference to FIG. 4, and assuming that the driving fluid chamber 74 and the driven fluid chamber 44 are filled with driving fluid and driven fluid respectively, the operation of the pump on a pressure stroke will first be explained. During the pressure stroke, the cam 42 (FIG. 5) releases the actuating rod 91 from its operating position and permits the spring 92 to return the actuating rod 91 to a rest position in which the rod 91 does not act against the ball valve 89. This permits the return spring 90 to close the ball valve 89 against the seat 88 so that fluid cannot leak from the driving fluid chamber 74 past the ball valve 89 during the pressure stroke. As the piston 76 moves forward during the pressure stroke, the pressure in the driving fluid chamber 74 increases until such pressure is sufficient to move the diaphragm 65 to the right. This rightward or forward movement of the diaphragm 65 causes the driven fluid in the chamber 44 to unseat the ball 56 and pump the fluid from the chamber 44 to the outlet fitting 58. When the pressure in the driving fluid chamber 74 reaches its set maximum pressure as determined by the relief valve 102 (FIG. 6), the ball 112 is pushed away from the seat 111 allowing the high pressure fluid from the driving fluid chamber 74 to flow through the outlet passage 99 past the valve 102 to the return passage 104 leading back to the crankcase 12. On each pressure stroke of the piston 76, a predetermined amount of driving fluid from the chamber 74 flows through the valve 102 back to the crankcase 12.

When the piston 76 and the diaphragm 65 reach their forward positions, the crank 41 begins to pull the piston 76 back towards its retracted position on a suction stroke. This begins to decrease the pressure in the driving fluid chamber 74, permitting the diaphragm 65 to being its movement back to the left to decrease the pressure in the driven fluid chamber 44. When the pressure in the driving fluid chamber 74 begins to go negative, the cam 42 (FIG. 5) acts against the rod 91 causing the rod 91 to open the inlet ball valve 89. The negative pressure in the driving fluid chamber 74 then causes the fluid from the crankcase 12 to flow through the tube 93 and the ball valve 89 and inlet passage 85 to the driving fluid chamber 74. The lack of a positive pressure on the left side of the diaphragm 65 during the suction stroke permits the spring 68 to continue moving the diaphragm 65 back toward its retracted position. This creates a negative pressure in the driven fluid chamber 44 and causes driven fluid to unseat the ball valve 49 against the very light leaf spring 50 to fill the driven fluid chamber 44 with the fluid to be pumped.

During this suction stroke of the pump, the negative pressure in the driving fluid chamber 74 is not required to unseat the ball valve 89 since this is accomplished mechanically by the rod 91. Similarly, the negative pressure in the driving fluid chamber 74 does not have to be of sufficient magnitude to pull the diaphragm 65 back to its retracted position or to pull driven fluid past the inlet ball valve 49 into the driven fluid chamber 44, since this is accomplished by the spring 68. This arrangement permits the use of a heavy return spring 90 on the driving fluid chamber inlet ball valve 89, so that fluid leakage past the ball valve 89 at the beginning of a pressure stroke is minimized. Additionally, it is believed that this arrangement minimizes the magnitude of the negative pressure in the driving fluid chamber 74 on a suction stroke and thereby reduces the volume of air which is drawn out of solution from the driving liquid on the suction stroke. Still further, the direct mounting of the rear pump housing 14 on the hermetically sealed crankcase 12 eliminates all external exposed lines for the inlet and return of the driving fluid and permits a single liquid to be used both for the driving fluid and for lubricating the bearings on the crankshaft 25 and on the crank 41 and the bearing surface on the cam 42.

Having described the operation of the pump during pumping of the driven fluid, the operation of the pump on standby will now be described. During standby, the outlet flow of fluid from the driven chamber 44 is terminated, such as would occur when the pump is used for spray painting and the painting is temporarily terminated while the motor 11 continues to drive the piston 76 back and forth. The pump under these conditions operates the same as during pumping, with the exception that the diaphragm 65 either remains stationary or moves very little. The piston 76, on the pressure stroke, then pushes a larger amount of fluid through the outlet passage 99 and the high pressure relief valve 102 on each pressure stroke of the piston. When flow of driven fluid through the driven fluid chamber 44 resumes such as when the operator again commences to paint, the diaphragm 65 is again able to move back and forth to provide the desired pumping through the driven fluid chamber 44.

What is claimed is:

1. A piston diaphragm pump comprising a crankcase defining a reservoir for driving fluid, a crankshaft rotatably journaled in said crankcase, said crankshaft including a crank, said crankcase having a front wall and a mounting hole in said front wall, a housing having a driving fluid chamber adjacent said front wall and overlying said mounting hole, said housing having a driven fluid chamber and a flexible diaphragm separating said chambers from one another, inlet and outlet passages extending between said crankcase and said driving fluid chamber for circulating said driving fluid between said reservoir and driving fluid chamber, said inlet and outlet passages both extending through said front wall of said crankcase, a piston mounted on said housing for reciprocating movement relative to said driving fluid chamber to provide a suction stroke and a pressure stroke, a connecting rod connecting said piston and said crank, said piston being axially aligned with and extending through said mounting hole, a valve disposed in said inlet passage and a spring biasing said valve to a normally closed position, mechanical means engaging said valve and moving said valve from said closed position against the bias of said spring to an open position for passage of said driving fluid from said reservoir to said driving fluid chamber during said suction stroke of said piston, and said mechanical means extending through said mounting hole.

2. A piston diaphragm pump as set forth in claim 1, wherein said crankshaft includes a cam, and said mechanical means include a mechanical actuator extending between said cam and said valve.

3. A piston diaphragm pump as set forth in claim 1, said diaphragm being movable between a forward position and a rearward position, and a spring biasing said diaphragm to said rearward position.

4. A piston diaphragm pump comprising a housing, a driving fluid chamber, a driven fluid chamber, a diaphragm separating said fluid chambers from one another and movable between a rearward position and a forward position, a reciprocating piston in fluid communication with said driving fluid chamber, mechanical drive means including a crankshaft and a connecting rod moving said piston from a forward position to a rearward position on a suction stroke and from said rearward position to said forward position on a pressure stroke, a hermetically sealed crankcase encapsulating said crankshaft and providing a reservoir for driving fluid, an inlet passage extending between said crankcase and said driving fluid chamber, a valve disposed in said inlet passage, a spring biasing said valve to a normally closed position, and mechanical means engaging said valve and moving said valve from said closed position against the bias of said spring to an open position for passage of said driving fluid from said reservoir to said driving fluid chamber during said suction stroke of said piston, said crankcase including a front wall having a mounting hole, said housing being disposed adjacent to said mounting hole and having said driving fluid chamber overlying said mounting hole, and said mechanical drive means and mechanical means extending through said mounting hole.

5. A piston diaphragm pump as set forth in claim 4, said crankshaft including a cam, and said mechanical means including a mechanical actuator extending between said cam and said valve.

6. A piston diaphragm pump as set forth in claim 5, including an outlet passage extending between said driving fluid chamber and said crankcase through said front wall of said crankcase, and a high pressure relief valve in said outlet passage including external adjustment means mounted on said housing.

7. A piston diaphragm pump comprising a crankcase defining a reservoir for driving fluid, a crankshaft rotatably journaled in said crankcase, said crankshaft including a crank and a cam, said crankcase having a front wall and a mounting hole in said front wall, a housing having a driving fluid chamber adjacent said front wall at the location of said mounting hole, said housing having a driven fluid chamber and a flexible diaphragm separating said chambers from one another, said flexible diaphragm being movable between a forward position and a rearward position, a spring biasing said diaphragm to said rearward position, a piston mounted on said housing for reciprocating movement relative to said driving fluid chamber from a forward position to a rearward position on a suction stroke and from said rearward position to said forward position on a pressure stroke, a connecting rod connecting said piston and said crank, an inlet passage and an outlet passage extending between said crankcase and said driving fluid chamber through said front wall, a high pressure relief valve in said outlet passage, an inlet valve in said inlet passage, a valve spring biasing said inlet valve toward a normally closed position, and a mechanical actuator extending between said cam and said inlet valve and engaging said inlet valve to open said inlet valve against the bias of said valve spring when said piston reaches a predetermined position on said suction stroke, said piston and mechanical actuator both extending through said mounting hole.

8. A piston diaphragm pump as set forth in claim 7, said inlet passage including a hole in said housing extending from said driving fluid chamber to said front wall of said crankcase, and an inlet valve assembly extending through said mounting hole.

9. A piston diaphragm pump as set forth in claim 8, said inlet valve being a ball valve in said inlet valve assembly, and said mechanical actuator including an actuator rod in said inlet valve assembly.

* * * * *